US008735748B2

(12) United States Patent
Yamada

(10) Patent No.: US 8,735,748 B2
(45) Date of Patent: May 27, 2014

(54) KEYBOARD STRUCTURE

(75) Inventor: Shigeru Yamada, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 533 days.

(21) Appl. No.: 12/737,869

(22) PCT Filed: Jun. 4, 2010

(86) PCT No.: PCT/JP2010/059562
§ 371 (c)(1),
(2), (4) Date: Feb. 24, 2011

(87) PCT Pub. No.: WO2011/004667
PCT Pub. Date: Jan. 13, 2011

(65) Prior Publication Data

US 2011/0155551 A1 Jun. 30, 2011

(30) Foreign Application Priority Data

Jul. 7, 2009 (JP) ..... 2009-161204

(51) Int. Cl.
*H01H 9/26* (2006.01)

(52) U.S. Cl.
USPC ..... 200/5 A

(58) Field of Classification Search
USPC ..... 200/5 A, 512, 517, 302.1, 302.2, 200/341–345
See application file for complete search history.

(56) References Cited

U.S. PATENT DOCUMENTS

| | | | | |
|---|---|---|---|---|
| 5,362,934 | A * | 11/1994 | Inagaki et al. | 200/520 |
| 5,847,336 | A * | 12/1998 | Thornton | 200/5 A |
| 6,023,033 | A | 2/2000 | Yagi et al. | |
| 6,180,895 | B1 | 1/2001 | Hutchinson et al. | |
| 6,180,896 | B1 * | 1/2001 | Naritomi | 200/5 A |
| 6,677,545 | B2 * | 1/2004 | Kenmochi | 200/314 |
| 2004/0257829 | A1 | 12/2004 | Suwa et al. | |
| 2007/0235306 | A1 * | 10/2007 | Chiba et al. | 200/314 |
| 2009/0103964 | A1 | 4/2009 | Takagi et al. | |
| 2009/0133999 | A1 * | 5/2009 | Yamada et al. | 200/345 |

FOREIGN PATENT DOCUMENTS

| | | | |
|---|---|---|---|
| CN | 1262989 | A | 8/2000 |
| JP | 63119119 | | 5/1988 |
| JP | 64-220 | | 1/1989 |
| JP | 10-162689 | A | 6/1998 |
| JP | 2000-182474 | A | 6/2000 |
| JP | 2005-032703 | A | 2/2005 |
| JP | 2008-235065 | A | 10/2008 |
| JP | 2008-293922 | A | 12/2008 |
| JP | 2009-099386 | A | 5/2009 |
| JP | 2009-146642 | A | 7/2009 |

* cited by examiner

*Primary Examiner* — Edwin A. Leon
(74) *Attorney, Agent, or Firm* — Rabin & Berdo, P.C.

(57) ABSTRACT

There is provided a keyboard structure capable of preventing a fingernail of a user from being inserted between key tops and achieving uniform illumination without illumination leakage. A key top body portion (120*a*) and an upper sheet (120*b*) are integrally formed to form a key top (120) and a flange portion (120*d*) is formed by protruding the upper sheet (120*b*) from the key top body portion (120*a*) toward an outer circumferential direction. A frame (122) is disposed between the adjacent key tops (120) and a gap is closed by the flange portion (120*d*) of the upper sheet (120*b*) and a flange portion (122*a*) of the frame (122).

11 Claims, 12 Drawing Sheets

KEYBOARD STRUCTURE

TECHNICAL FIELD

The invention relates to a keyboard structure to be used as an input apparatus in information processing apparatuses, measuring instruments, medical equipment, and the like, and more particularly, to a keyboard structure having an illumination function.

BACKGROUND ART

Japanese Patent Application Laid-Open (JP-A) No. 2008-293922 (Patent Document 1) discloses a conventional keyboard structure. The keyboard structure disclosed in Document 1 has a water-proof function wherein a movable plate, which is movable together with a key top, is disposed below a key cap and a sheet-shaped elastic member is disposed between the key top and the movable plate. In the keyboard structure, a link mechanism, which includes two link members, a rubber dome, a membrane sheet, and a back plate, is disposed below the movable plate. A water-proof property is realized for the link mechanism by covering the link mechanism with the sheet-shaped elastic member.

As a reference to a keyboard structure having an illumination function, there is JP-A No. 2008-235065 (Patent Document 2) disclosing a structure in which a back plate, which supports a membrane sheet, is imparted with light permeability and light reflectivity to exhibit uniform illumination with a simple structure, so that a back plate functions as a light guiding and a substrate. When light is incident from an LED light source disposed to face the back plate, the back plate directs the incident light toward the key top. This causes a character or a symbol on the key top to be illuminated.

DISCLOSURE OF THE INVENTION

Problems to be Solved by the Invention

In the keyboard structure disclosed in Document 1, however, there was a concern that a fingernail of a user is likely to be inserted between a key top and a key top adjacent thereto during the operation and as a result, when the user extracts the fingernail, the fingernail is likely to be caught in the key top, resulting in the removal of the key top. In the keyboard structure disclosed in Document 1, a cylindrical fitting portion is formed on a rear surface of the key top and the movable plate is coupled to the fitting portion. However, since the fitting portion is thick, there is a concern that non-uniform illumination occurs when it is provided with an illumination function. Regarding the keyboard structure disclosed in Document 2, there is a problem of light leakage from a gap between the key tops because the light is emitted from the entire back plate.

An object of the invention is to provide a keyboard structure capable of preventing a fingernail of a user from being inserted between key tops and achieving uniform illumination without illumination leakage.

Means for Solving the Problems

In order to resolve the above-mentioned problems, the keyboard structure of the invention relates to a keyboard structure having plural key switches, each closing a contact point when a key top is pressed down. The keyboard structure includes a sheet-shaped member including a protrusion integrally formed with a body portion of the key top and protruding from an outer circumferential end of the key top.

Effects of the Invention

According to the invention, by provision of a sheet-shaped member having a protrusion protruding from an outer circumferential end of a key top and being integrally formed with a body portion of the key top, it may be possible to prevent a fingernail of a user from being inserted into a gap between the key tops and as a result, uniform illumination may be achieved and illumination leakage may be prevented.

BEST MODE FOR CARRYING OUT THE INVENTION

Figure 1:
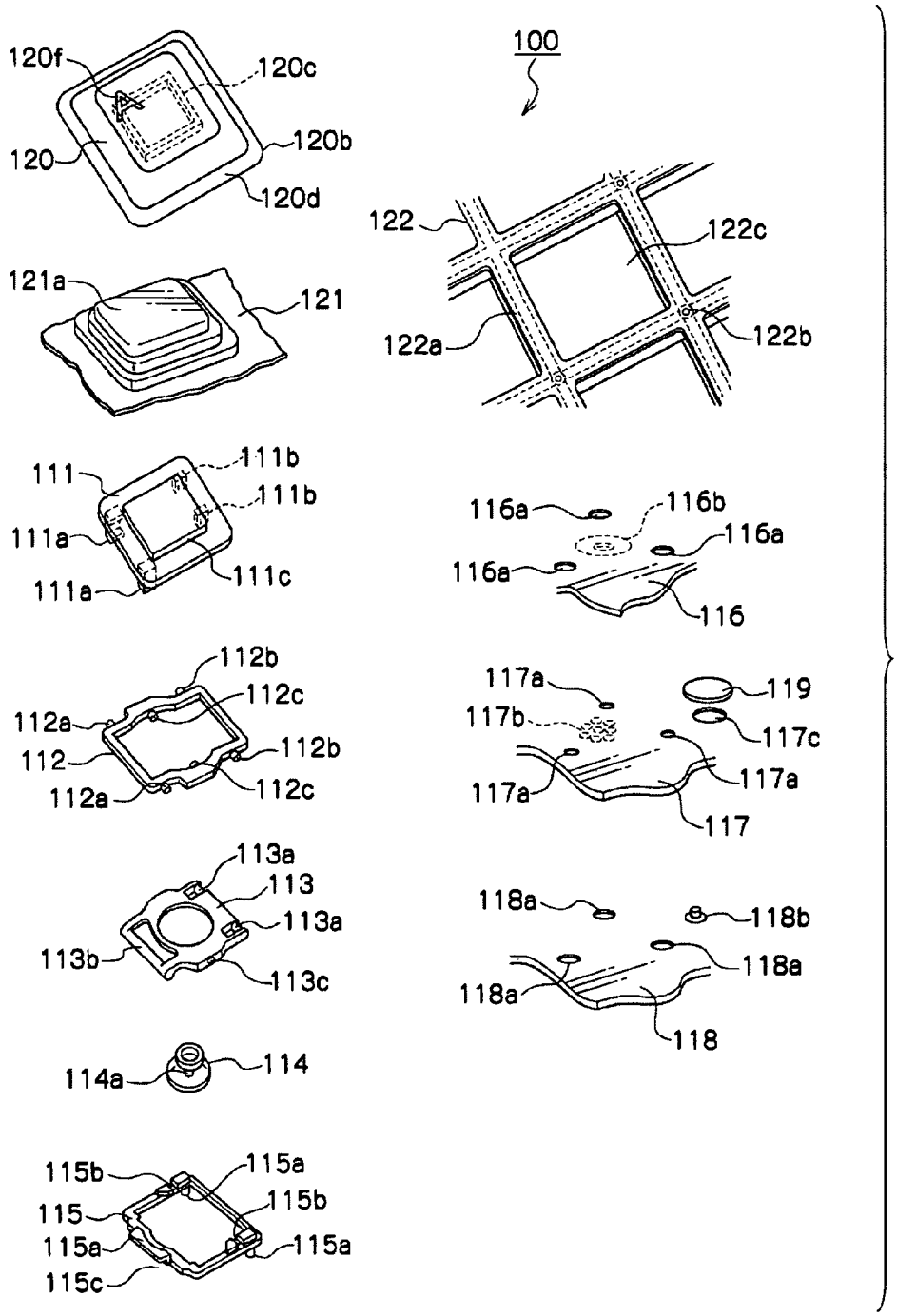
FIG. 1 is an exploded perspective view illustrating a keyboard structure according to a first embodiment.
Figure 2:
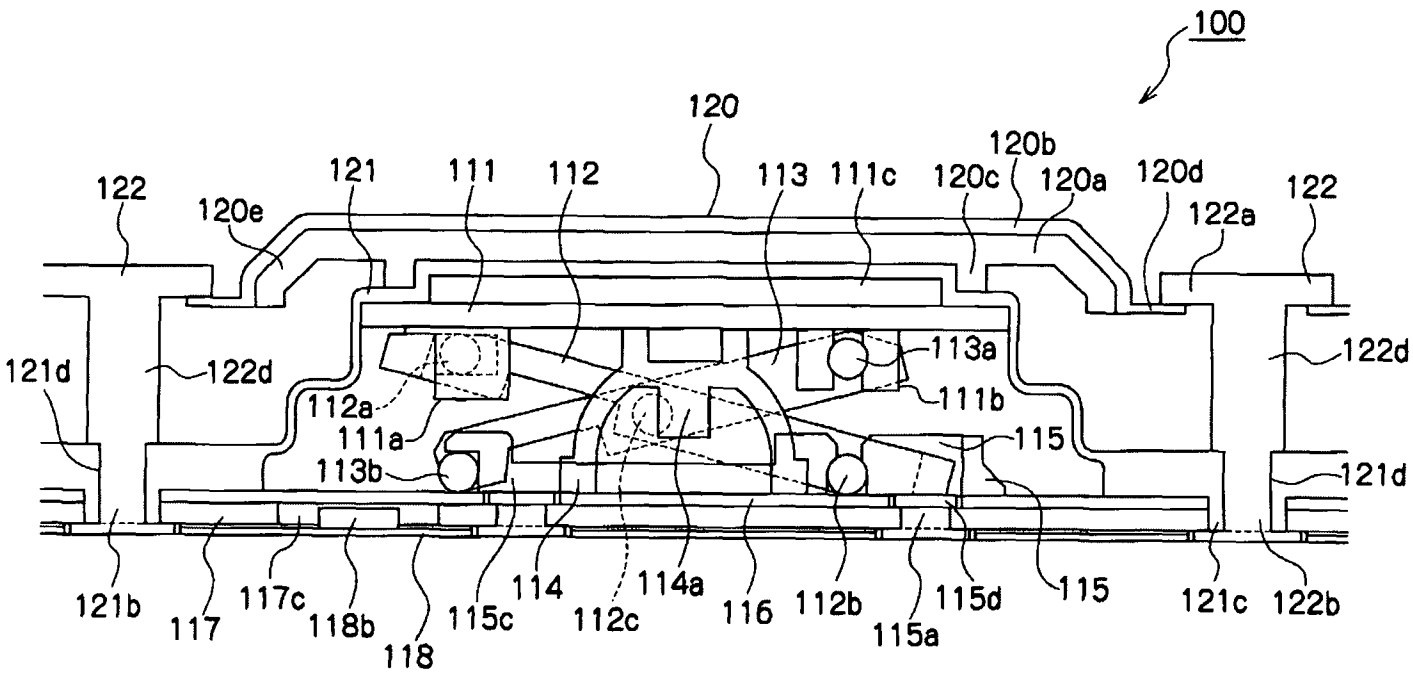
FIG. 2 is a sectional view illustrating the keyboard structure according to the first embodiment.

Hereinafter, embodiments of the invention will be described in detail with reference to the drawings. The common elements in the drawings are denoted by the same reference numerals. FIG. 1 is an exploded perspective view illustrating a keyboard structure according to a first embodiment of the invention. FIG. 2 is a sectional view illustrating the keyboard structure according to the first embodiment.

As shown in FIGS. 1 and 2, a key switch 100 according to the first embodiment includes: a key top 120; a sheet-shaped elastic member 121 disposed below the key top 120; a movable plate 111 fixing the sheet-shaped elastic member 121 together with the key top 120; a first link member 112 slidably disposed on the movable plate 111; a second link member 113 rotatably disposed on the movable plate 111; a rubber dome (returning member) 114 which is bent when the movable plate 111 is pressed down and helps the movable plate 111 return to the original position when the pressing force is released; a holder 115 holding the first link member 112 and the second link member 113; a membrane sheet 116 having a contact point portion directly below the rubber dome 114; a back plate 117 supporting the membrane sheet 116 and having a light guiding function; an LED sheet 118 provided with a light-emitting diode (LED); and a frame 122.

Figure 3:
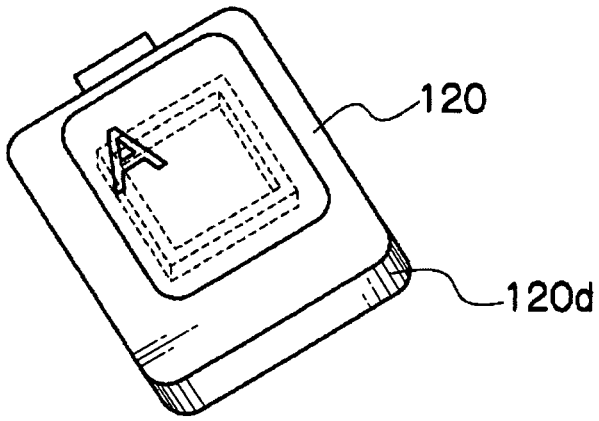
FIG. 3 is a perspective view illustrating a key top according to a modification thereof.

The key top 120 includes a key top body portion 120*a* and an upper sheet 120*b*. The upper sheet 120*b* is formed integrally with the key top body portion 120*a* and is formed in the shape conforming to the outer shape of the key top body portion 120*a*. The upper sheet 120*b* is made of polycarbonate, polyethylene terephthalate (PET), or the like. A flange portion (protrusion) 120*d*, which horizontally protrudes from the key top body portion 120*a*, is formed at the ends of the outer circumference of the upper sheet 120*b*. In this embodiment, the flange portion 120*d* is formed around the circumference of the key top 120, as shown in FIG. 1. However, as shown in FIG. 3, the flange portion 120*d* may be formed on one side surface of the key top 120, as necessary. FIG. 3 is a perspective view illustrating a key top according to a modification.

As shown in FIG. 2, the flange portion 120*d* is disposed to come into contact with the rear side of a flange portion 122*a* of the frame 122 described below, when the key top 120 is not pressed down. Thus, with the flange portion 120*d* and the flange portion 122*a* of the frame 122, which are arranged in such way, a gap between the key top 120 and the key top 120 adjacent thereto may be closed up, as described below.

On the surface of the rear side (the key top body portion 120*a* side) of the upper sheet 120*b*, a designated color (for example, black) is printed in the entire region expect for a character portion (also the flange portion 120*d* is printed) and a designated character color (for example, white) is printed in the character portion to form a character-printed portion 120*f*. When the key top body portion 120*a* and the upper sheet 120*b* are integrally formed, the upper sheet 120*b* is formed and a skirt portion 120*e* is formed at the end thereof at an inclination angle that is set such that printing may be performed. By forming the character-printed portion 120*f* on the rear side of the upper sheet 120*b*, it is possible to prevent the printed character from being damaged when a pressing operation is repeated. When tampo printing or silk printing is performed on the upper sheet 120*b*, no printing is performed in portions other than the character portion.

Figure 4:
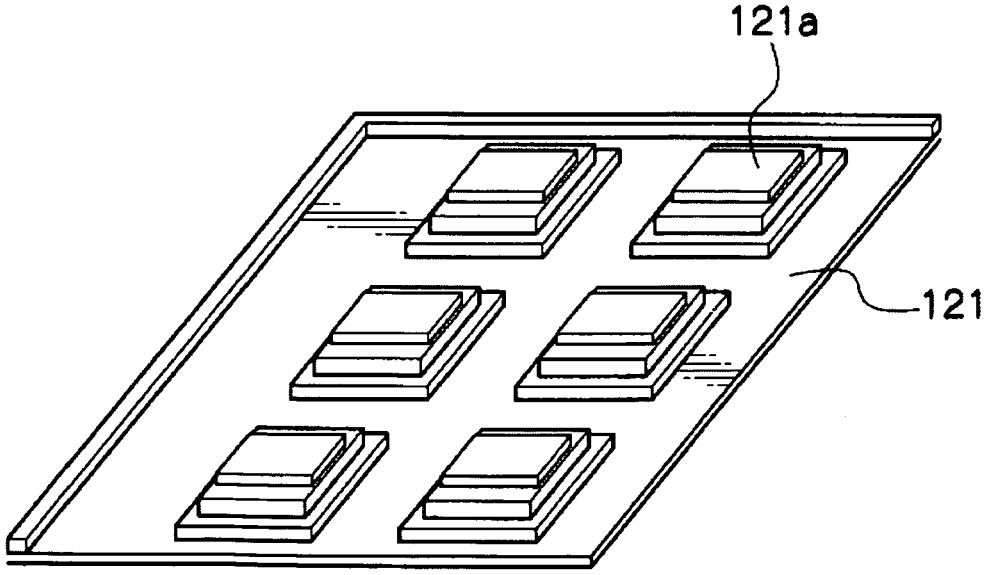
FIG. 4 is a perspective view illustrating a sheet-shaped elastic member according to the first embodiment.

On the rear side of the key top body portion 120*a*, a fixing frame 120*c* is formed to fix the sheet-shaped elastic member 121. A fixation portion 121*a* is disposed above the sheet-shaped elastic member 121. The sheet-shaped elastic member 121 is positioned and fixed in a manner such that the fixation portion 121*a* is inserted into the inside of the fixing frame 120*c* and is pressed by a bulging portion 111*c* of the movable plate 111 from the lower side. In this embodiment, the sheet-shaped elastic member 121 is made of rubber. As shown in FIG. 4, the sheet-shaped elastic member 121 is formed as one sheet for the entire keyboard and is disposed to cover the members located thereof (the movable plate 111, the first link member 112, the second link member 113, the rubber dome 114, the holder 115, the membrane sheet 116, the back plate 117, and the LED sheet 118). FIG. 4 is a perspective view illustrating the sheet-shaped elastic member.

Figure 5:
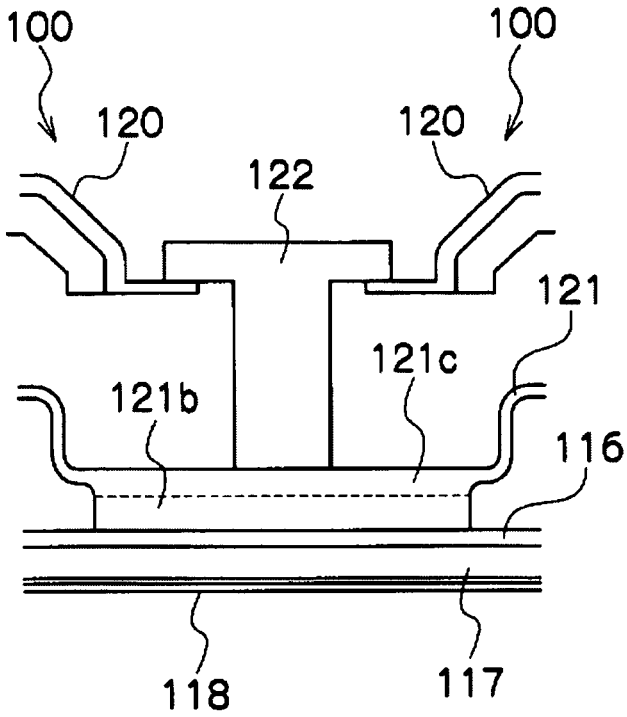
FIG. 5 is a sectional view illustrating a boundary portion of the sheet-shaped elastic member according to the first embodiment.

As described above, the sheet-shaped elastic member 121 is disposed to extend over the plural key switches 100. However, as shown in FIG. 5, an air groove 121*b* is formed in a boundary portion 121*c* of the sheet-shaped elastic member 121 between the key switches. The air groove 121*b* allows an air to be circulated between the key switch and the key switch adjacent thereto and below the sheet-shaped elastic member 121. When the key top 120 is pressed down, the air moves between the adjacent key switches. However, the air groove 121*b* may not be provided. The air groove 121*b* is not necessary when a space below the sheet-shaped elastic member 121 is large enough to allow the key top to be pressed down without giving any influence.

Sliding support portions 111*a* and rotation support portions 111*b* are disposed on the rear surface of the movable plate 111. The sliding support portions 111*a* slidably support sidling pins 112*a* of the first link member 112 in a horizontal direction, respectively. The rotation support portions 111*b* rotatably support rotation pins 113*a* of the second link member 113, respectively. The first link member 112 is formed in a substantial frame shape. The first link member 112 includes pins 112*c* inserted into support holes 113*c* (only one is illustrated in FIG. 1, but the support holes 113*c* are disposed on both sides) of the second link member 113 and pins 112*b* rotatably held by support portions 115*b* of the holder 115 in addition to the sliding pins 112*a*.

The second link member 113 includes, in addition to the rotation pins 113*a*, support holes 113*c*, into which the pins 112*c* of the first link member 112 are respectively inserted, and pins 113*b*, which are guided to a sliding support portion 115*c* of the holder 115 and thus slid. The rubber dome 114 is disposed below the movable plate 111 and is formed of a rubber material in the shape of a substantial cup. In the middle of the inner surface of the rubber dome 114, a contact pressing portion 114*a* protrudes downward to press down a contact point portion 116*b* of the membrane sheet 116. The first link member 112 and the second link member 113 form a link mechanism.

Figure 6:
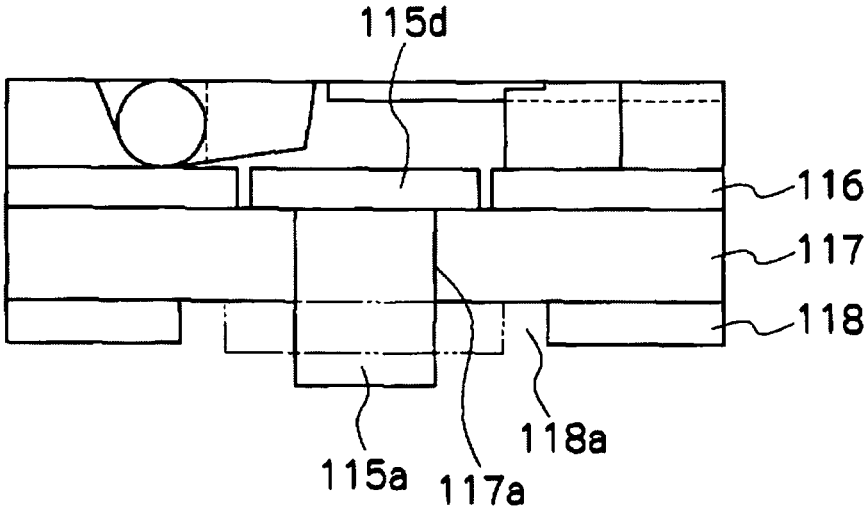
FIG. 6 is an enlarged view illustrating the welded state of a welding pin.

The holder 115 is separated in a unit of one key switch 100. The holder 115 is formed in the shape of a frame. The holder 115 is provided with the support portions 115*b*, the sliding support portion 115*c*, and plural welding pins 115*a*. The support portions 115*b* rotatably support the pins 112*b* of the first link member 112, respectively. The sliding support portion 115*c* slidably supports the pin 113*b* of the second link member 13. The welding pins 115*a* are inserted into holes 117*a* formed in the back plate 117 having a light guiding function. As shown in FIG. 2, a flange portion 115*d* is formed at the upper portion (base portion) of the welding pin 115*a*. When the key switches are assembled, as show in FIG. 6, the welding pins 115*a* are inserted into the holes 117*a* of the back plate 117, and then are deformed from a pin shape to a flat plate shape, as indicated by a two-dot chain line, by thermally welding the front end portions of the welding pins 115*a* so as to be fixed around the lower part of the holes 117*a*. Then, the holder 115 is strongly fixed to the back plate 117 so that the welding pins 115*a* do not protrude downward. FIG. 6 is an enlarged view illustrating the welded state of the welding pins.

The first link member 112, the second link member 113, and the holder 115 are made of a transparent or translucent material. The membrane sheet 116 includes the contact point portion 116*b* (shown in FIG. 1) pressed down by the contact pressing portion 114*a* of the rubber dome 114. Moreover, the membrane sheet 116 has holes 116*a* into which the flange portions 115*d* of the holder 115 are inserted. Although not illustrated, the membrane sheet 116 includes upper and lower sheets each having flexibility and a spacer sheet interposed between the upper and lower sheets. In the spacer sheet, plural through holes are formed to correspond to plural keys. The through hole forms a space between the upper and lower sheets. A fixed contact point is formed on the lower sheet closer to the back plate 117 and a movable contact point is formed on the upper sheet closer to the rubber dome 114 so that the fixed contact point and the movable contact point face each other. The fixed contact point and the movable contact point form the contact point portion 116*b*.

The back plate 117 having the light guiding function is made of resin or the like with transparency or high permeability. Therefore, light passes through the inside of the back plate 117 with refraction. The back plate 117 is provided with the holes 117*a*, into which the welding pins 115*a* of the holder 115 are inserted, at plural positions corresponding to the holes 116*a* of the membrane sheet 116. The back plate 117 is provided with a through hole 117*c* formed at the position corresponding to the position at which an LED 118*b* is disposed. The through hole 117*a* has a diameter smaller than that of the hole 116*a* of the membrane sheet 116. A shielding (reflection) seal 119 is attached onto the through hole 117*c* to prevent the light of the LED 118*b* from leaking.

The shielding seal 119 is stronger than the LED 118*b* in luminance and is disposed at the position at which the light of the LED 118*b* permeates through the membrane sheet 116 from the back plate 117 side. The back plate 117 is provided with a reflection portion 117*b*. The reflection portion 117*b* reflects the internally reflected light toward the key top 120 and is formed in the shape of a dot at the position corresponding to the character-printed portion 120*f* of the key top 120. Therefore, the plural reflection portions 117*b* may be formed for one key switch. Moreover, the reflection portion 117*b* may be formed as a concavo-convex portion with a dot shape.

In the LED sheet 118, welding holes 118*a* are formed at the positions corresponding to the welding pins 115*a* of the holder 115. In the LED sheet 118, the LED 118*b* is disposed at the position corresponding to the through hole 117*c* of the back plate 117. The welding hole 118*a* is formed to be sufficiently larger than the hole 117*a* of the back plate 117. The LED 118*b* may be disposed at any position on the LED sheet 118. The upper surface of the LED sheet 118 and the lower surface of the back plate 117 are attached to each other by an adhesive or the like.

Figure 7:
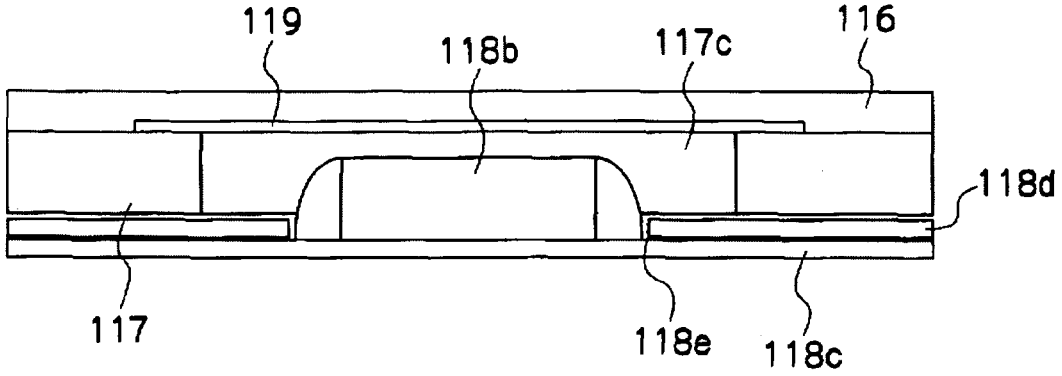
FIG. 7 is a detailed enlarged view illustrating an LED disposed portion according to the first embodiment.

FIG. 7 is a detailed enlarged view illustrating an LED disposed portion according to the first embodiment. The membrane sheet 116, the back plate 117, the LED sheet 118, and the LED 118*b* are shown. In FIG. 7, the LED sheet 118 includes a lower surface LED sheet portion 118*c* and an upper surface reflection sheet portion 118*d*. The upper side of the lower surface LED sheet portion 118*c* is attached to the lower side of the upper surface reflection sheet portion 118*d*. In the upper surface reflection sheet portion 118*d*, a hole 118*e* is formed at the position corresponding to the LED 118*b*. The LED 118*b* is disposed in the lower surface LED sheet portion 118*c* and a sheet-shaped pattern is printed. The LED 118*b* is bonded thereto. The lower surface LED sheet portion 118*c* and the upper surface reflection sheet portion 118*d* are attached to each other by a water-proof paste or the like so as to realize a water-proof function. The upper surface reflection sheet portion 118*d* may be imparted with a reflection function in a manner of printing a material with reflectivity on the upper surface or the lower surface of a transparent PET sheet. The LED 118*b* may be mounted without forming a hole.

Figure 8:
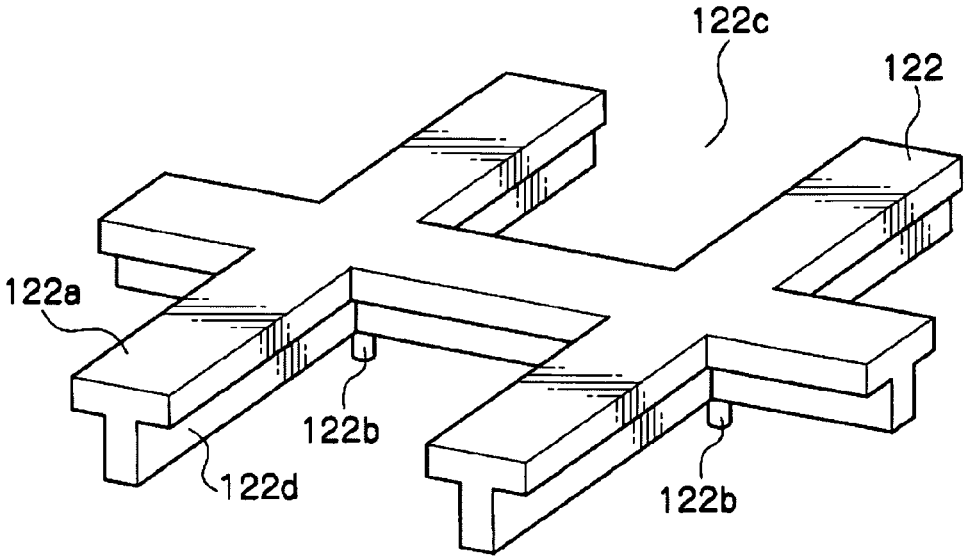
FIG. 8 is a perspective view illustrating a notched frame.

The frame 122 is formed in a lattice shape, as shown in FIG. 1. The key top 120 is disposed in each of the holes 122*c* of the frame 122. Therefore, the holes 122*c* are formed as many as the key tops 120. FIG. 8 is a perspective view illustrating a notched frame. As shown in FIGS. 2 and 8, the frame 122 is formed in the shape of a substantial T in a cross-section view and includes the flange portion 122*a* covering the flange portion 120*d* of the key top 120 and a vertical portion 122*d*. When a key is not pressed down, as shown in FIG. 1, the upper surface of the flange portion 120*d* of the key top 120 comes into contact with the lower surface of the flange portion 122*a*. In this case, the contact force may be obtained by the rubber dome 114. Thus, the configuration with no gap between the adjacent key tops 120 may be realized.

Plural welding pins 122*b* are formed at optional positions in the frame 122. The welding pins 122*b* protrude downward from the vertical portion 122*d* and are inserted into the holes 121*d* (shown in FIG. 2) formed in the sheet-shaped elastic member 121. When the welding pins 122*b* are inserted into the holes 121*d*, the front end portions of the welding pins 122*b* protrude downward more than the LED sheet 118. When the frame 122 is fixed to the sheet-shaped elastic member 121, the front end portions of the welding pins 122*b* are thermally welded and deformed, as shown in FIG. 2. Thus, the tubular portion 121*c* of the sheet-shaped elastic member 121 is fixed between the vertical portion 122*d* and the welded part of the welding pin 122*b*.

Next, a switching operation will be described according to the first embodiment. In FIG. 2, when the key top 120 is pressed down from the upper side with an optional load, the key top 120 moves downward. Then, the rubber dome 114 is bent, and thus the contact point pressing portion 114*a* of the rubber dome 114 presses a contact point (not shown) of the membrane sheet 116, causing a switch closed state. When the key top 120 is pressed down, the flange portion 120*d* of the upper sheet 120*b* gets away from the flange portion 122*a* of the frame 122 downward. Moreover, when the upper portion of the key top 120 is pressed down to some extent, the key top 120 moves downward, maintaining its posture horizontal due to the first link member 112 and the second link member 113, thereby achieving the switch closed state. When the pressing force on the key top 120 is released, the key top 120 is moved up by the returning force of the rubber dome 114, and thus returns to the original position. Thus, the flange portion 120*d* of the upper sheet 120*b* comes into contact with the rear surface of the flange portion 122*a* of the frame 122 and again closes the space between the key top 120 and the frame 122.

Next, an illumination operation will be described. In FIG. 2, when the LED 118*b* is turned on by a power supply (not shown), light emitted from the LED 118*b* passes through the inside of the back plate 117 having the light guiding function. Since the shielding seal 119 is disposed above the LED 118*b*, the light emitted from the LED 118*b* is reflected from the shielding seal 119 without upward leakage and passes through the inside of the back plate 117. Since the reflection portion 117*b* is disposed at the position corresponding to the character-printed portion 120*f* on the rear side of the upper sheet 120*b* of the key top 120, the light is reflected from the reflection portion 117*b*. The reflected light is emitted toward the key top 120 via the membrane sheet 116.

Since the membrane sheet 116 is made of a material with light permeability, the light passes through the membrane sheet 116. Moreover, the light reaches the rear surface of the key top 120 through the holder 115 and the rubber dome 114. Since the character-printed portion 120*f* of the key top 120 is illuminated from the rear surface, the character-printed portion 120 is brightly viewed from the upper surface side.

According to the first embodiment, since the flange portion 120*d* protruding in a horizontal direction is formed in the upper sheet 120*b* of the key top 120, a fingernail of a user is not inserted into the gap when the user presses down a key, resulting in obtainment of an advantage that coming off the key top 120 and erroneous input that may be caused by insertion of the fingernail less occurs. Moreover, since there is no space for an object to be inserted below the key top 120, the object is not caught in the key top 120, thereby preventing the key top 120 from being removed accidently or intentionally. Furthermore, since the gap between the adjacent key tops 120 is closed by the flange portion 120*d* of the upper sheet 120*b* and the flange portion 122*a* of the frame 122, it is possible to ensure the water-proof property of the keyboard structure.

In this embodiment, the upper sheet 120*b* and the key top body portion 120*a* are integrally formed to form the key top 120 and the character-printed portion 120*f* is formed on the rear surface of the upper sheet 120*b*, it is possible to prevent a character or a symbol printed on the character-printed portion 120*f* from being erased although a key operation is frequently performed. Therefore, a key display may satisfactorily be maintained. Moreover, since the flange portion 120*d* is formed and the gap is configured to be closed by the upper sheet 120*b* integrally formed with the key top body portion 120*a* and the flange portion 120*d*, the overall height of the key top 120 may be suppressed low. In this embodiment, since the entire link mechanism (the first link member 112 and the second link member 113) is covered with the sheet-shaped elastic member 121, the water-proof function may be ensured particularly for the membrane sheet 116 or the LED sheet 118. That is, since it is not necessary to realize the drip-proof property for the membrane sheet 116 or the LED sheet 118, cost may be reduced.

In this embodiment, since the gap between the key tops 120 is closed by the flange portion 120*d* of the upper sheet 120*b* of the key top 120 and the flange portion 122*a* of the frame 122, it is possible to prevent light from leaking when the light is emitted. Moreover, since the back plate 117 functions as a light guiding plate, a base portion becomes thin and thus it is possible to replace a non-illumination type keyboard by an illumination type keyboard. Since the number of parts is reduced, cost may be reduced. Moreover, since an advantage is also obtained in a way of simply mounting the back plate 117 on the illumination type key board, a keyboard may be manufactured according to the same processing as that of a conventional non-illumination type keyboard.

Figure 9:
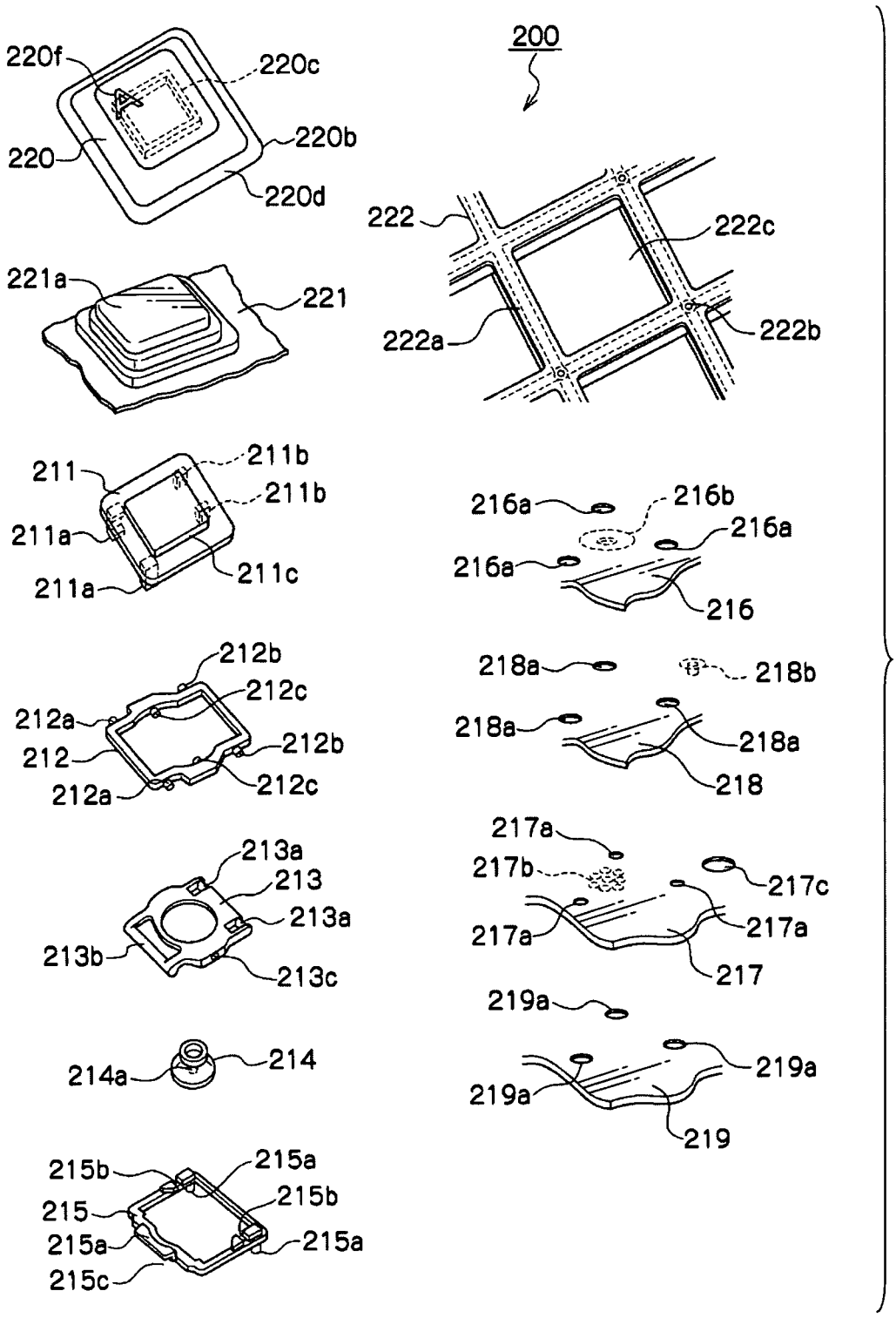
FIG. 9 is an exploded perspective view illustrating a keyboard structure according to a second embodiment.
Figure 10:
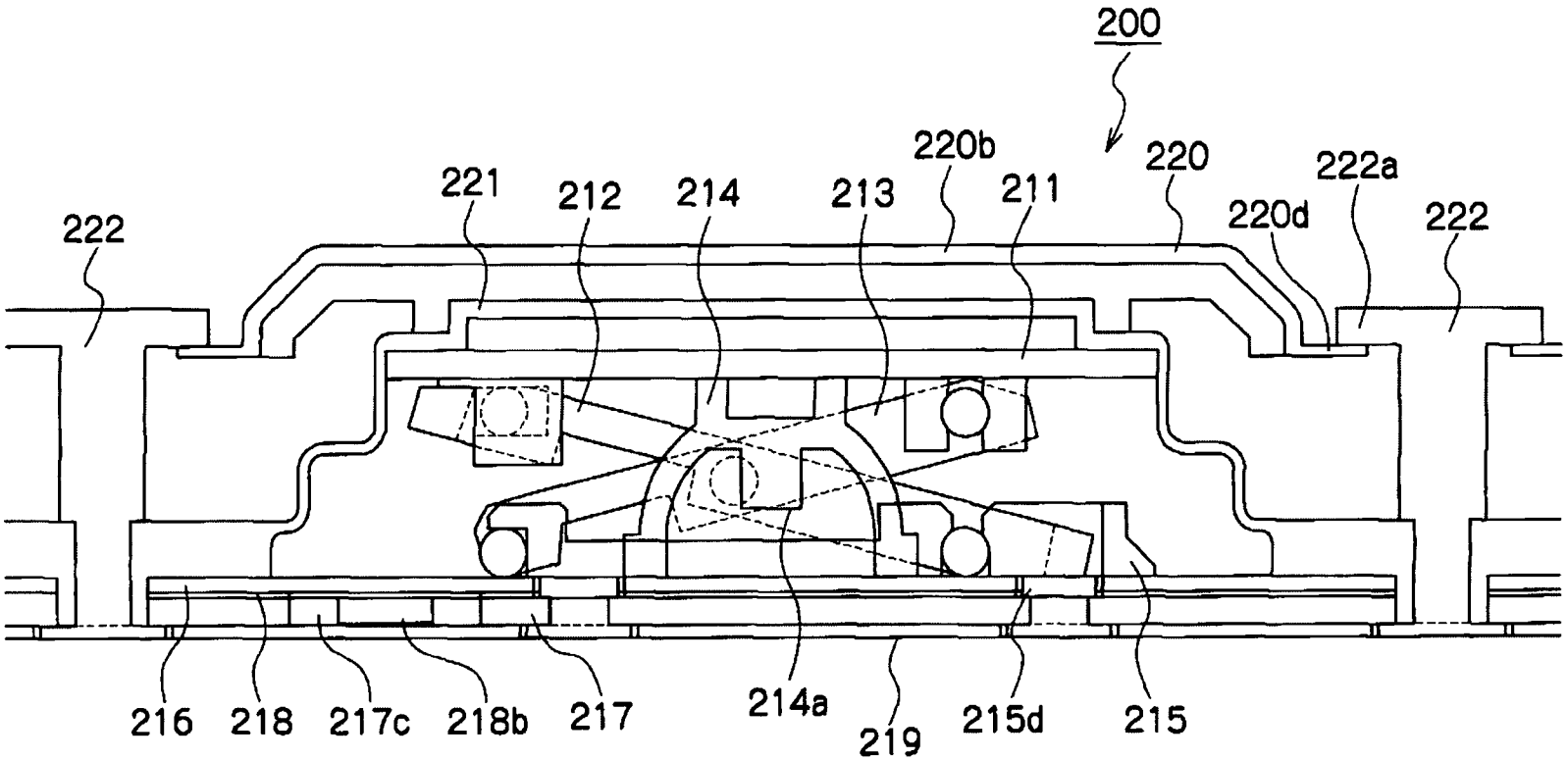
FIG. 10 is a sectional view illustrating the keyboard structure according to the second embodiment.

Next, a second embodiment of the invention will be described. FIG. 9 is an exploded perspective view illustrating a keyboard structure according to the second embodiment. FIG. 10 is a sectional view illustrating the keyboard structure according to the second embodiment. In FIGS. 9 and 10, a key switch 200 according to the second embodiment includes a key top 220, a sheet-shaped elastic member 221, a movable plate 211, a first link member 212, a second link member 213, a rubber dome 214, a holder 215, and a frame 222, all of which have the same configuration as that of the above-described first embodiment. A membrane sheet 216, an LED sheet 218, a back plate 217, and a reflection sheet 219 are disposed below the holder 215 in this order. The LED sheet 218 is provided with an LED 218*b*.

In the LED sheet 218, holes 218*a* are formed at the positions corresponding to flange portions 215*d* (shown in FIG. 10) of welding pins 215*a* of the holder 215. The hole 218*a* has a diameter larger than that of the flange portion 215*d* of the welding pin 215*a*. The LED 218*b* is disposed at the position corresponding to a through hole 217*c* of the back plate 217. The LED 218*b* may be disposed at any position on the LED sheet 218.

Figure 11:
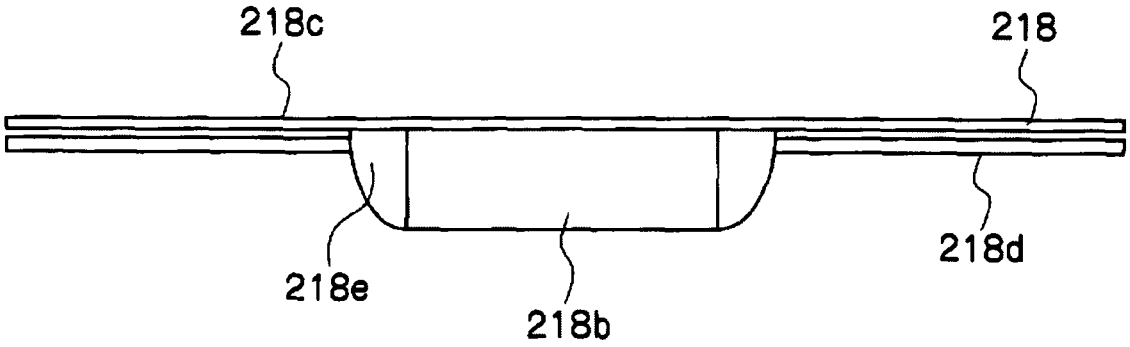
FIG. 11 is a detailed enlarged view illustrating an LED disposed portion according to the second embodiment.

FIG. 11 is a detailed enlarged view illustrating an LED disposed portion according to the second embodiment. In FIG. 11, the LED sheet 218 includes an upper surface LED sheet portion 218*c* and a lower surface reflection sheet portion 218*d*. The lower side of the upper surface LED sheet portion 218*c* is attached to the upper side of the lower surface reflection sheet portion 218*d*. In the lower surface reflection sheet portion 218*d*, a hole 218*e* is formed at the position corresponding to the LED 218*b*. The LED 218*b* is disposed downward in the upper surface LED sheet portion 218*c* and a sheet-shaped pattern is printed. The LED 218*b* is bonded thereto. The upper surface LED sheet portion 218*c* and the lower surface reflection sheet portion 218*d* are attached to each other by a water-proof paste or the like so as to realize a water-proof function. However, in this embodiment, since the LED sheet 218 is covered with the sheet-shaped elastic member 221, it is not necessary to attach the upper surface LED sheet portion 218*c* to the lower surface reflection sheet portion 218*d* by the water-proof paste.

The lower surface reflection sheet portion 218*d* may be imparted with a reflection function in a manner of printing a material with reflectivity on the upper surface or the lower surface of a transparent PET sheet. In addition, when the membrane sheet 216 has a reflection function, it is not necessary for the lower surface reflection sheet portion 218*d* to have the reflection function. On the other hand, when the LED sheet 218 has no reflection function, the LED sheet 218 may include only the upper surface LED sheet portion 218*c*. That is, the upper surface LED sheet portion 218*c* serves as the LED sheet 218. The LED sheet 218 is disposed below the membrane sheet 216.

The membrane sheet 216 includes a contact point portion 216*b* pressed down by the contact point pressing portion 214*a* of the rubber dome 214. The membrane sheet 216 is provided with holes 216*a* into which the flange portions 215*d* (shown in FIG. 10) of the holder 215 are inserted. As in the first embodiment, since the back plate 217 having the light guiding function is made of resin or the like with transparency, or high permeability, light passes through the inside of the back plate 217 with refraction. In the back plate 217, holes 217*a* are formed through at plural positions corresponding to the holes 216*a* of the membrane sheet 216 and the holes 218*a* of the LED sheet 218. The welding pins 215*a* of the holder 215 are inserted into the holes 217*a*. In the back plate 217, the through hole 217*c* is formed at the position corresponding to the position at which the LED 218*b* is disposed. The through hole 217*a* is set to have a diameter smaller than that of the hole 216*a* of the membrane sheet 216 and the hole 218*a* of the LED sheet 218. A reflection portion 217*b* is formed on the back plate 217.

In the reflection sheet 219, holes 219*a* are formed at the positions corresponding to the welding pins 215*a* of the holder 215. Since the reflection sheet 219 may be attached to the lower side of the back plate 217 by an adhesive or the like, the reflection sheet 219 may not necessarily be attached by the welding pins 215*a*. The reflection sheet 219 reflects the light emitted from the LED 218*b* toward the back plate 217.

Since the key pressing operation of the second embodiment is the same as that of the above-described first embodiment, the description thereof will not be repeated. In the second embodiment, an illumination operation will be described. In FIG. 10, when the LED 218*b* is turned on by a power supply (not shown), the light emitted from the LED 218*b* passes through the inside of the back plate 217 having the light guiding function. Since the reflection sheet 219 is disposed below the LED 218*b*, the light emitted from the LED 218*b* is reflected from the reflection sheet 219 without downward leakage and passes through the inside of the back plate 217. Since the LED sheet 218 or the membrane sheet 216 having the reflection function is disposed above the back plate 217, the light emitted from the LED 218*b* passes through the inside of the back plate 217 without upward leakage. The light is reflected from the reflection portion 217*b* disposed at the position corresponding to the character-printed portion 220*f* of the key top 220. The reflected light is emitted toward the key top 220 via the LED sheet 218 and the membrane sheet 216.

Then, the light reaches the rear surface of the key top 220 through the membrane sheet 216 and further through the holder 215 and the rubber dome 214, as in the first embodiment. Since the character-printed portion 220*f* of the key top 220 is illuminated from the rear surface, the character-printed portion 120 is brightly viewed from the upper surface side.

In the second embodiment, it is possible to obtain the same advantages as those of the above-described first embodiment. Moreover, since the LED 218*b* is disposed downward, it is possible to reduce the influence of the luminance of the LED 218*b* on the upper surface of the keyboard. Furthermore, it is not necessary to have a shielding seal that closes the through hole 217*c* of the back plate 217 in which the LED 218*b* is disposed.

Figure 12:
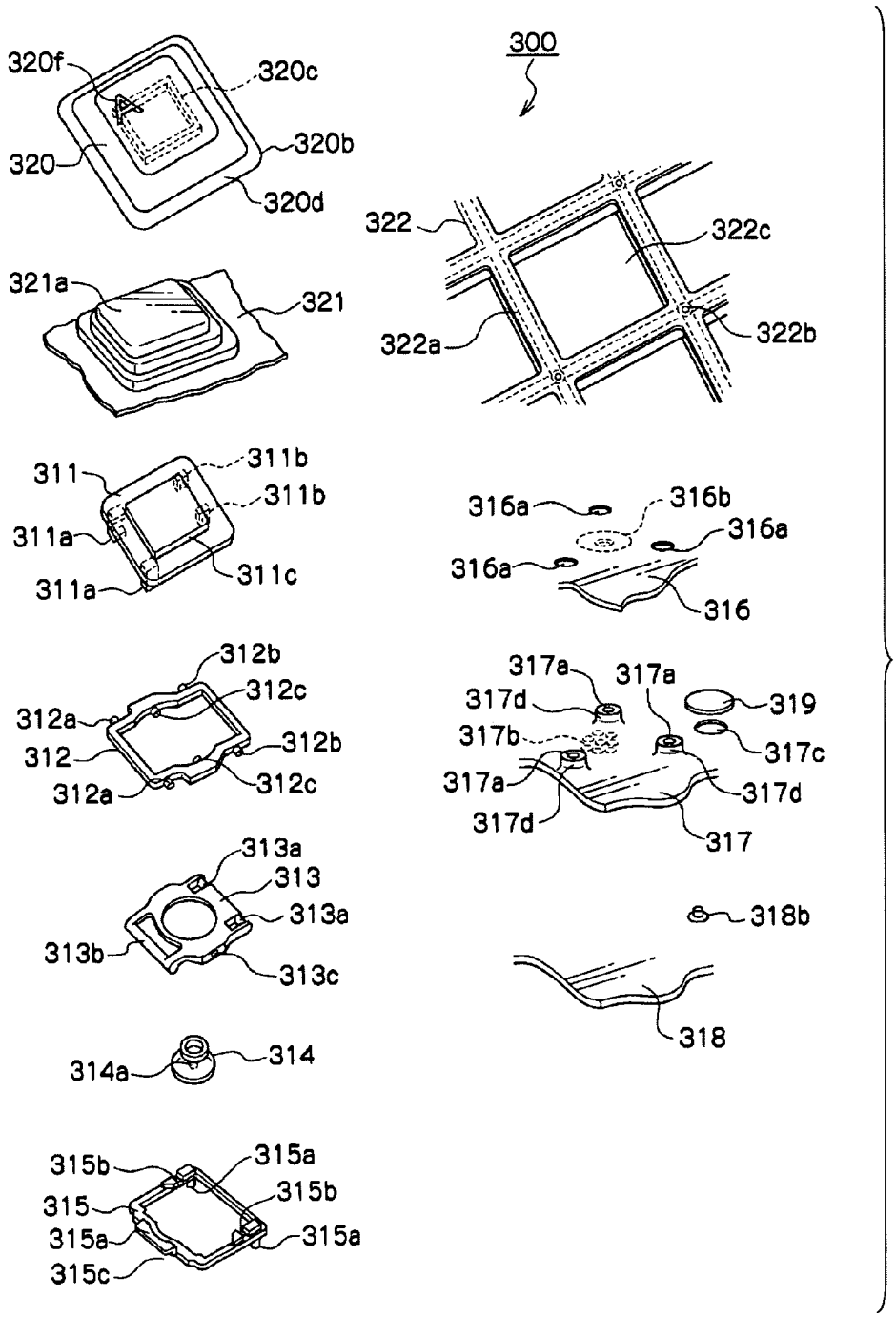
FIG. 12 is an exploded perspective view illustrating a keyboard structure according to a third embodiment.
Figure 13:
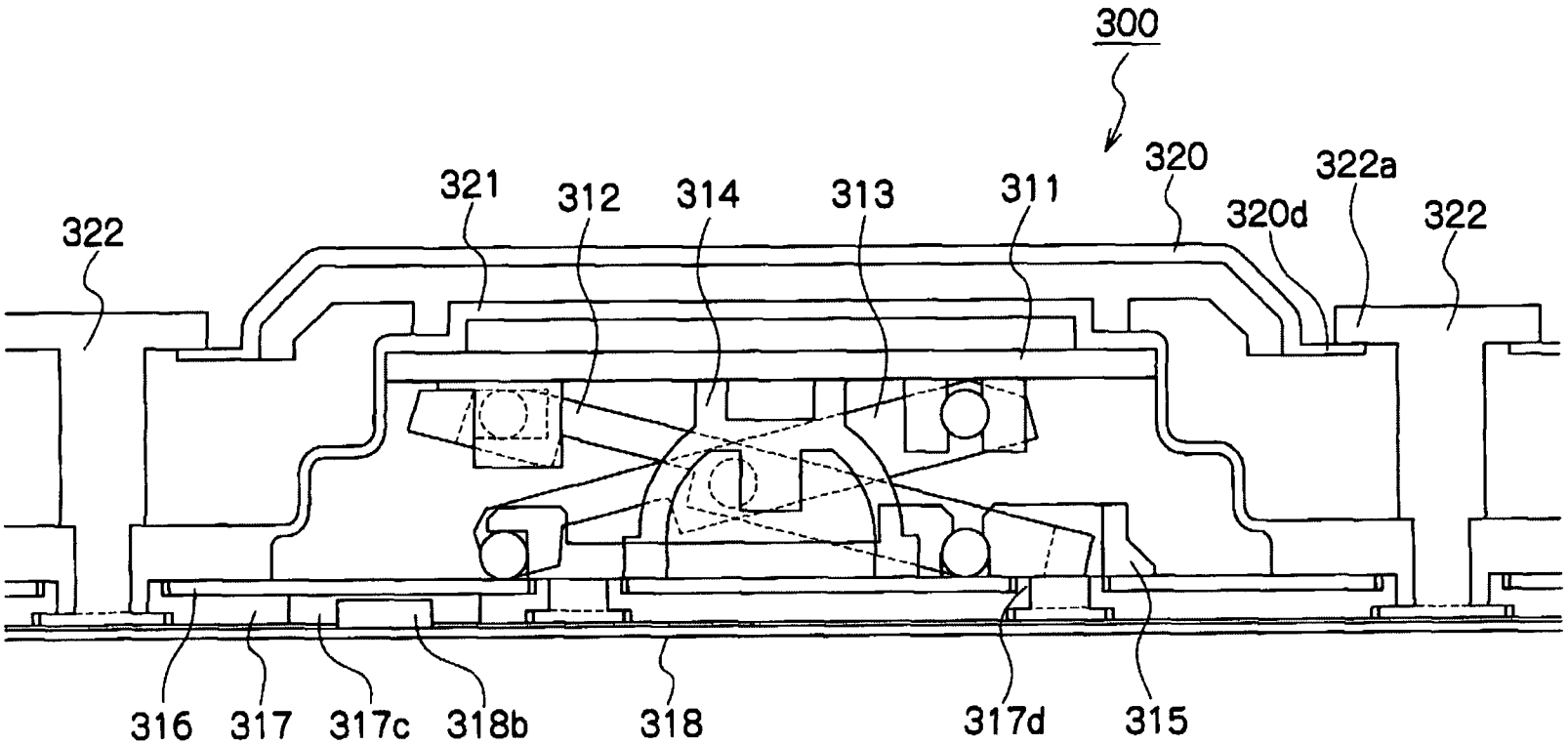
FIG. 13 is a sectional view illustrating the keyboard structure according to the third embodiment.

Next, a third embodiment of the invention will be described. FIG. 12 is an exploded perspective view illustrating a keyboard structure according to the third embodiment. FIG. 13 is a sectional view illustrating the keyboard structure according to the third embodiment. In FIGS. 12 and 13, a key switch 300 according to the third embodiment includes a key top 320, a sheet-shaped elastic member 321, a movable plate 311, a first link member 312, a second link member 313, a rubber dome 314, a holder 315, and a frame 322, all of which have the same configuration as that of the above-described first and second embodiments. A membrane sheet 316, a back plate 317, and an LED sheet 318 are disposed below the holder 315 in this order.

The membrane sheet 316 includes a contact point portion 316*b* pressed down by a contact point pressing portion 314*a* of the rubber dome 314. Moreover, the membrane sheet 316 has holes 316*a* into which welding pins 315*a* of the holder 315 are inserted. The back plate 317 having a light guiding function is provided with holes 317*a* formed therethrough at plural positions corresponding to the holes 316*a* of the membrane sheet 316. The welding pins 315*a* of the holder 315 are inserted into the holes 317*a*. In addition, the back plate 317 is provided with a through hole 317*c* formed at the position corresponding to the position at which the LED 318*b* is disposed. An impressed portion 317*d* is formed in the back plate 317 and the hole 317*a* is formed in the impressed portion 317*d*. The hole 317*a* has a diameter smaller than that of the hole 316*a* of the membrane sheet 316. A shielding (reflection) seal 319 is attached onto an upper portion of the through hole 317*c* so that the light emitted from the LED 318*b* does not leak.

The shielding seal 319 is stronger than the LED 318*b* in luminance and is attached at the position at which the light of the LED 318*b* permeates through the membrane sheet 316 from the back plate 317. The back plate 317 is provided with a reflection portion 317*b*. The reflection portion 317*b* is formed in the shape of a dot at the position corresponding to the character-printed portion 320*f* of the key top 320.

The height of the impressed portion 317*d* of the back plate 317 is slightly higher than the thickness of the membrane sheet 316. A space is formed below the impressed portion 317*d*, and thus the front end portion of the welding pin 315*a* of the holder 315 is thermally welded in this space. Therefore, as shown in FIG. 13, the bottom surface of the welding pin 315*a* is maintained horizontally after the welding, although there is no hole in the LED sheet 318. Therefore, the LED sheet 318 has no hole as described in the first embodiment. No flange portion is formed in the welding pin 315*a* of the holder 315.

The assembling operation and the illumination operation according to the third embodiment are the same as those of the first embodiment. According to the third embodiment, it is possible to obtain the same advantages as those of the first embodiment. Moreover, since there is provided the impressed portion 317*d* in the back plate 317 having the light guiding function, the front end portion of the welding pin 315*a* of the holder 315 is inserted into the inside of the impressed portion 317*d* to be welded. Therefore, the welded portion does not protrude downward from the back plate 317. Since it is not necessary to form a hole in the LED sheet 318, the water-proof property may be ensured.

Figure 14:
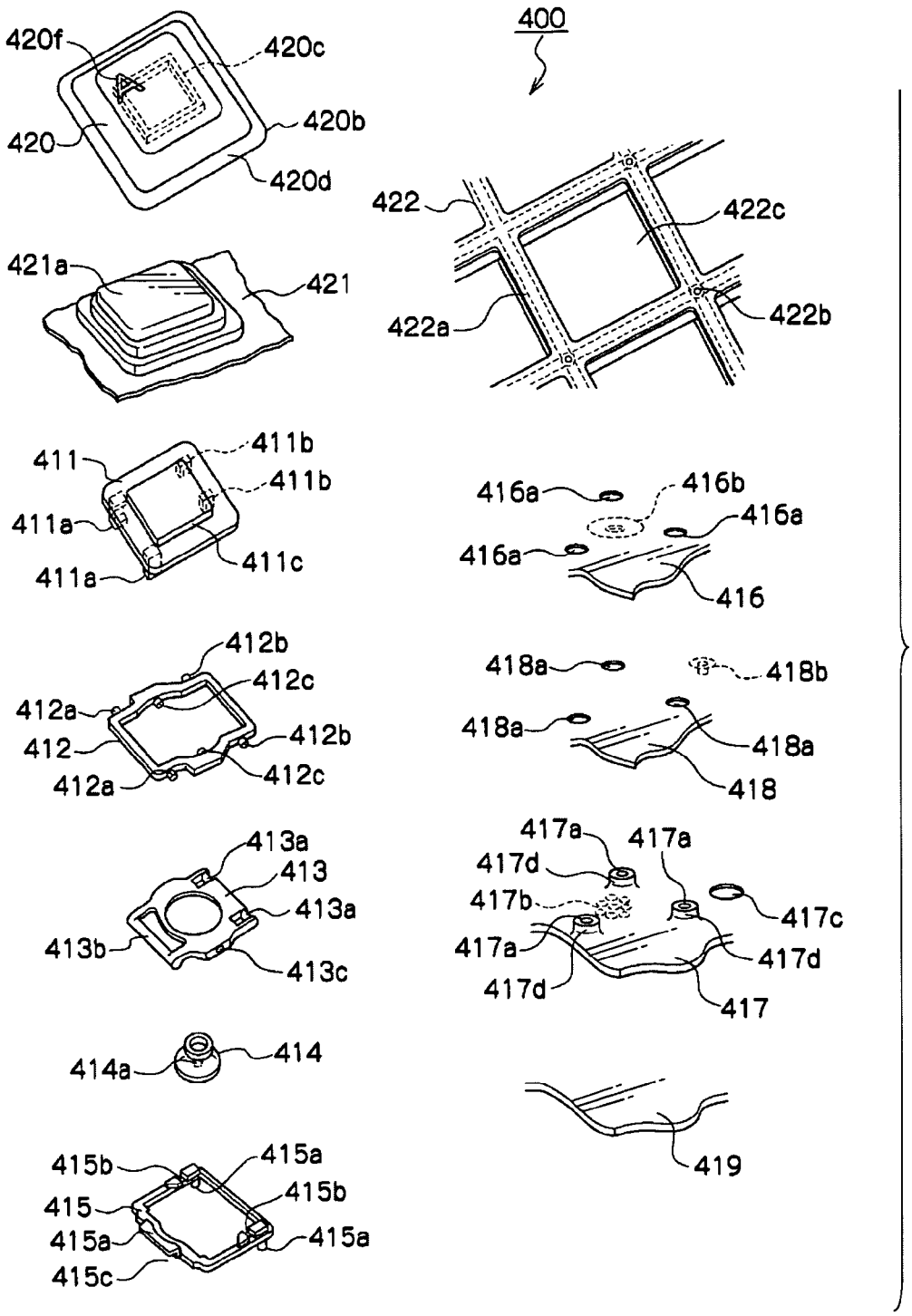
FIG. 14 is an exploded perspective view illustrating a keyboard structure according to a fourth embodiment.
Figure 15:
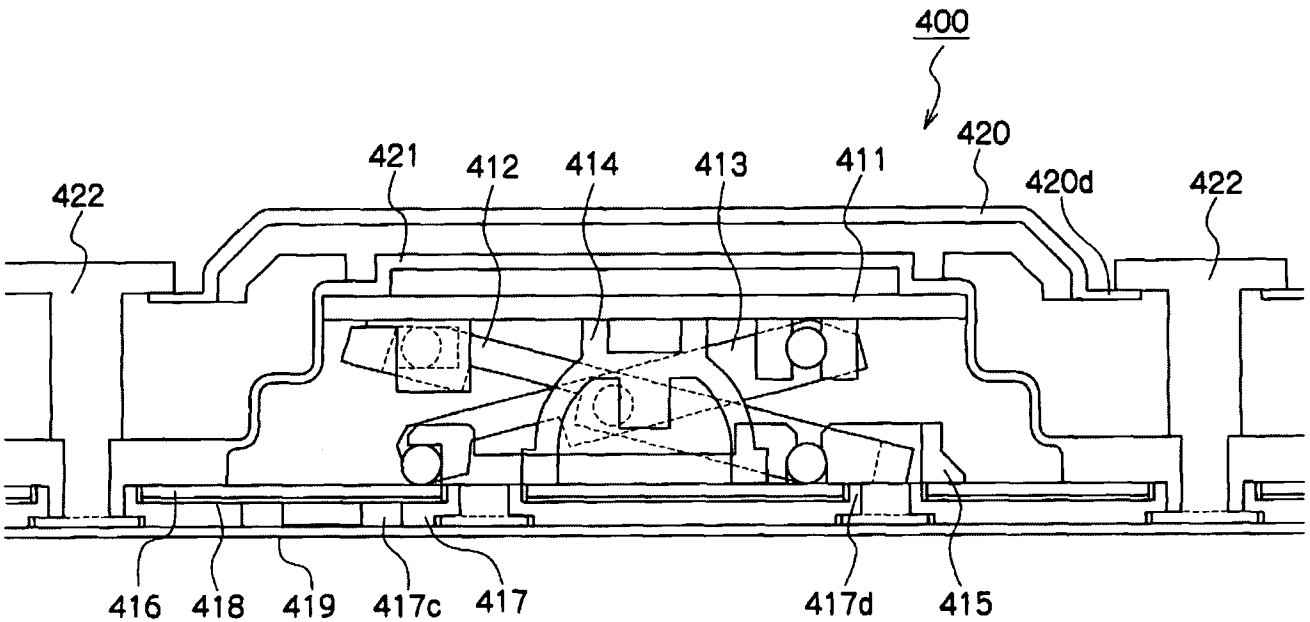
FIG. 15 is a sectional view illustrating the keyboard structure according to the fourth embodiment.

Next, a fourth embodiment of the invention will be described. FIG. 14 is an exploded perspective view illustrating a keyboard structure according to the fourth embodiment. FIG. 15 is a sectional view illustrating the keyboard structure according to the fourth embodiment. In FIGS. 14 and 15, a key switch 400 according to the fourth embodiment includes a key top 420, a sheet-shaped elastic member 421, a movable plate 411, a first link member 412, a second link member 413, a rubber dome 414, a holder 415, and a frame 422, all of which have the same configuration as that of the above-described first embodiment. A membrane sheet 416, an LED sheet 418, a back plate 417, and a reflection sheet 419 are disposed below the holder 415 in this order. The LED sheet 418 is provided with an LED.

The membrane sheet 416 and the LED sheet 418 have the same configurations as those of the membrane sheet 216 and the LED sheet 218 of the above-described second embodiment. In the back plate 417 having the light guiding function, holes 417*a* are formed therethrough at plural positions corresponding to holes 416*a* of the membrane sheet 416. Welding pins 415*a* of the holder 415 are inserted into the holes 417*a*. In the back plate 417, a through hole 417*c* is formed at the position corresponding to the position at which an LED 418*b* is disposed. The back plate 417 is provided with impressed portions 417*d*. The hole 417*a* is formed in the impressed portion 417*d*. The hole 417*a* has a diameter smaller than that of the hole 416*a* of the membrane sheet 416. No shielding seal is attached at the lower portion of the through hole 417*c*. The back plate 417 is provided with a reflection portion 417*b* printed in the shape of a dot. The reflection sheet 419 disposed at a lower portion of the back plate 417 has no hole as described in the second embodiment.

As in the third embodiment, the height of the impressed portion 417*d* of the back plate 417 is slightly higher than the thickness of the membrane sheet 416. A space is formed below the impressed portion 417*d*, and thus the front end portion of the welding pin 415*a* of the holder 415 is thermally welded in this space. Therefore, as shown in FIG. 15, the bottom surface of the welding pin 415*a* is maintained horizontally after the welding, although there is no hole in the LED sheet 418. Therefore, the LED sheet 418 has no hole as described in the second embodiment.

The assembling operation and the illumination operation according to the fourth embodiment are the same as those of the second embodiment. According to the fourth embodiment, it is possible to obtain the same advantages as those of the second embodiment. Moreover, since there is provided the impressed portion 417*d* in the back plate 417, the front end portion of the welding pin 415*a* is inserted into the inside of the impressed portion 417*d* so as to be welded. Therefore, the welded portion does not protrude downward from the back plate 417. Since it is not necessary to form a hole in the reflection sheet 419, the water-proof property may be ensured.

The invention is not limited to the above-described embodiments, but may be modified in various forms. For example, in the second and fourth embodiments, the LED sheets 218 and 418 are disposed below the membrane sheets 216 and 416. However, conversely, the membrane sheets 216 and 416 may be disposed below the LED sheets 218 and 418. In this case, a hole is formed in the membrane sheets 216 and 416 so that the LED may be inserted thereinto.

In the above-described embodiments, when the key top is pressed down, the flange portions of the sheets 120*b*, 220*b*, 320*b*, and 420*b* get away from the flange portions 122*a*, 222*a*, 322*a*, and 422*a* of the frame. Therefore, by providing a flexible film-shaped member between the flange portions of the sheets 120*b*, 220*b*, 320*b*, and 420*b* and the flange portions 122*a*, 222*a*, 322*a*, and 422*a* of the frame, respectively, it is possible to ensure the water-proof property when the key is pressed down.

The invention claimed is:

1. A keyboard structure comprising:

a plurality of key switches each having a key top having a sheet-shaped member that includes a protrusion protruding from an outer circumferential end of a body portion of the key top, the protrusion being integrally formed with the body portion of the key top, the protrusion forming an entire outer circumference of the key top, and a contact point that forms a switch closed state by pressing of the key top; and a frame member disposed between the key switches and having a flange portion, the frame member covering a space between the protrusion of one of the key switches and the protrusion of another of the key switches, the key top of the one key switch being adjacent to the key top of the another key switch, the flange portion directly contacting the protrusion of the one key switch when the key top of the one key switch is not pressed by a user, and the flange portion being free of contact with the protrusion of the one key switch when the key top of the one key switch is pressed by the user, and the sheet-shaped members of the key tops being independently provided from each other.

2. The keyboard structure according to claim 1, each of the key switches further comprising:

a link member disposed below the key top and supporting the key top so as to be movable vertically;

a returning member disposed below the key top and causing the key top, after being pressed by a user, to return to an original position;

a membrane sheet having the contact point; and a sheet-shaped elastic member covering each of the membrane sheet, the returning member and the link member.

3. The keyboard structure according to claim 2, wherein each of the key switches includes a movable member disposed above the link member and the returning member, and the key top includes a frame-shaped fixing portion, and the sheet-shaped elastic member is fixed between the frame-shaped fixing portion and the movable member.

4. The keyboard structure according to claim 2, further comprising:

a back plate disposed below the membrane sheets of the one and another key switches, the frame member being fixed to the back plate by thermal welding.

5. The keyboard structure according to claim 1, wherein for each of the key switches, the sheet-shaped member is formed of a member with light permeability, and has a surface close to a top of the key top, the key top having a character or a symbol for input.

6. The keyboard structure according to claim 1, each of the key switches further comprising:

a link mechanism supporting the key top so as to be movable vertically;

a membrane sheet having the contact point;

a back plate that is disposed below the membrane sheet, supports the link mechanism, and has a light guiding function; and a light-emitting element sheet member provided with a light-emitting element.

7. The keyboard structure according to claim 6, wherein for each of the key switches, the light-emitting element sheet member is disposed below the back plate and the back plate is provided with a shielding seal reflecting light of the light-emitting element.

8. The keyboard structure according to claim 6, wherein each of the key switches includes a reflection sheet, and the light-emitting element sheet member is disposed above the back plate and the reflection sheet is disposed below the back plate to reflect light of the light-emitting element.

9. The keyboard structure according to claim 6, each of the key switches further comprising:

a holder member which is disposed above the membrane sheet and supports the link mechanism;

a welding pin which is disposed in the holder member and protrudes toward the membrane sheet;

an impressed portion which is disposed in the back plate and protrudes through the back plate; and a hole which is formed in the impressed portion and into which the welding pin is inserted, wherein the holder member is fixed by inserting the welding pin into the hole and welding a front end portion of the welding pin to the impressed portion.

10. The keyboard structure according to claim 1, wherein each of the sheet-shaped members is free of contact with all others of the sheet-shaped members.

11. The keyboard structure according to claim 2, wherein for each key switch, the key top, the sheet-shaped elastic member, the link member and the membrane sheet are disposed in that stated order on a straight line.

* * * * *